US008922178B2

(12) United States Patent
Zhong et al.

(10) Patent No.: US 8,922,178 B2
(45) Date of Patent: Dec. 30, 2014

(54) TEMPERATURE DEPENDENT VOLTAGE REGULATOR

(75) Inventors: Kai Zhong, Gilbert, AZ (US); Pengbei Zhang, Chandler, AZ (US)

(73) Assignee: Intel IP Corporation, Santa Clara, CA (US)

( * ) Notice: Subject to any disclaimer, the term of this patent is extended or adjusted under 35 U.S.C. 154(b) by 1099 days.

(21) Appl. No.: 12/905,241

(22) Filed: Oct. 15, 2010

(65) Prior Publication Data

US 2012/0094613 A1 Apr. 19, 2012

(51) Int. Cl.
*G05F 1/00* (2006.01)
*G05F 3/02* (2006.01)
*G05F 1/567* (2006.01)

(52) U.S. Cl.
CPC ..... *G05F 1/567* (2013.01)
USPC ..... 323/273; 327/540

(58) Field of Classification Search
USPC ..... 323/273–281; 327/538, 540
See application file for complete search history.

(56) References Cited

U.S. PATENT DOCUMENTS

| | | | | |
|---|---|---|---|---|
| 4,939,442 | A * | 7/1990 | Carvajal et al. | 323/281 |
| 7,629,711 | B2 * | 12/2009 | Zhong et al. | 323/276 |
| 2003/0102851 | A1 * | 6/2003 | Stanescu et al. | 323/280 |
| 2006/0202821 | A1 * | 9/2006 | Cohen | 340/539.27 |
| 2007/0241728 | A1 * | 10/2007 | Demolli | 323/273 |
| 2009/0085545 | A1 * | 4/2009 | Shen et al. | 323/283 |

* cited by examiner

*Primary Examiner* — Jue Zhang
(74) *Attorney, Agent, or Firm* — Baker Botts L.L.P.

(57) ABSTRACT

Systems and methods for reducing power consumption of a voltage regulator are disclosed. In accordance with one embodiment of the present disclosure a voltage regulator comprises an input node configured to receive a reference voltage and an output node configured to output an output voltage. The output voltage is a function of the reference voltage and a regulating current. The regulator further comprises a proportional to absolute temperature (PTAT) circuit coupled to at least one of the output node and the input node. The PTAT circuit is configured to vary at least one of the reference voltage and the regulating current as a function of temperature.

9 Claims, 4 Drawing Sheets

TEMPERATURE DEPENDENT VOLTAGE REGULATOR

TECHNICAL FIELD

The present disclosure relates generally to voltage regulators and, more particularly, to a temperature dependent voltage regulator.

BACKGROUND

Electronic devices are constantly being improved to have more capability and increased performance. Portable electronic devices, especially in the telecommunications industry, are among one of the fastest growing and innovative segments of the electronics industry. The demands in this market include low cost, long battery life, small size, increased performance, and increased capabilities of these devices.

Electronic devices typically utilize voltage regulators to provide the appropriate amount of power to the various circuits included within them. The increased performance requirements and capabilities of the electronic devices, especially in portable electronic devices, also require an increase in the performance capabilities of the voltage regulators included within the devices. One such performance requirement is reduced power consumption.

SUMMARY

In accordance with the teachings of the present disclosure, the disadvantages and problems associated with reducing power consumption of voltage regulators may be reduced.

In accordance with one embodiment of the present disclosure a voltage regulator comprises an input node configured to receive a reference voltage and an output node configured to output an output voltage. The output voltage is a function of the reference voltage and a regulating current. The regulator further comprises a proportional to absolute temperature (PTAT) circuit coupled to at least one of the output node and the input node. The PTAT circuit is configured to vary at least one of the reference voltage and the regulating current as a function of temperature.

Other technical advantages will be apparent to those of ordinary skill in the art in view of the following specification, claims, and drawings.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
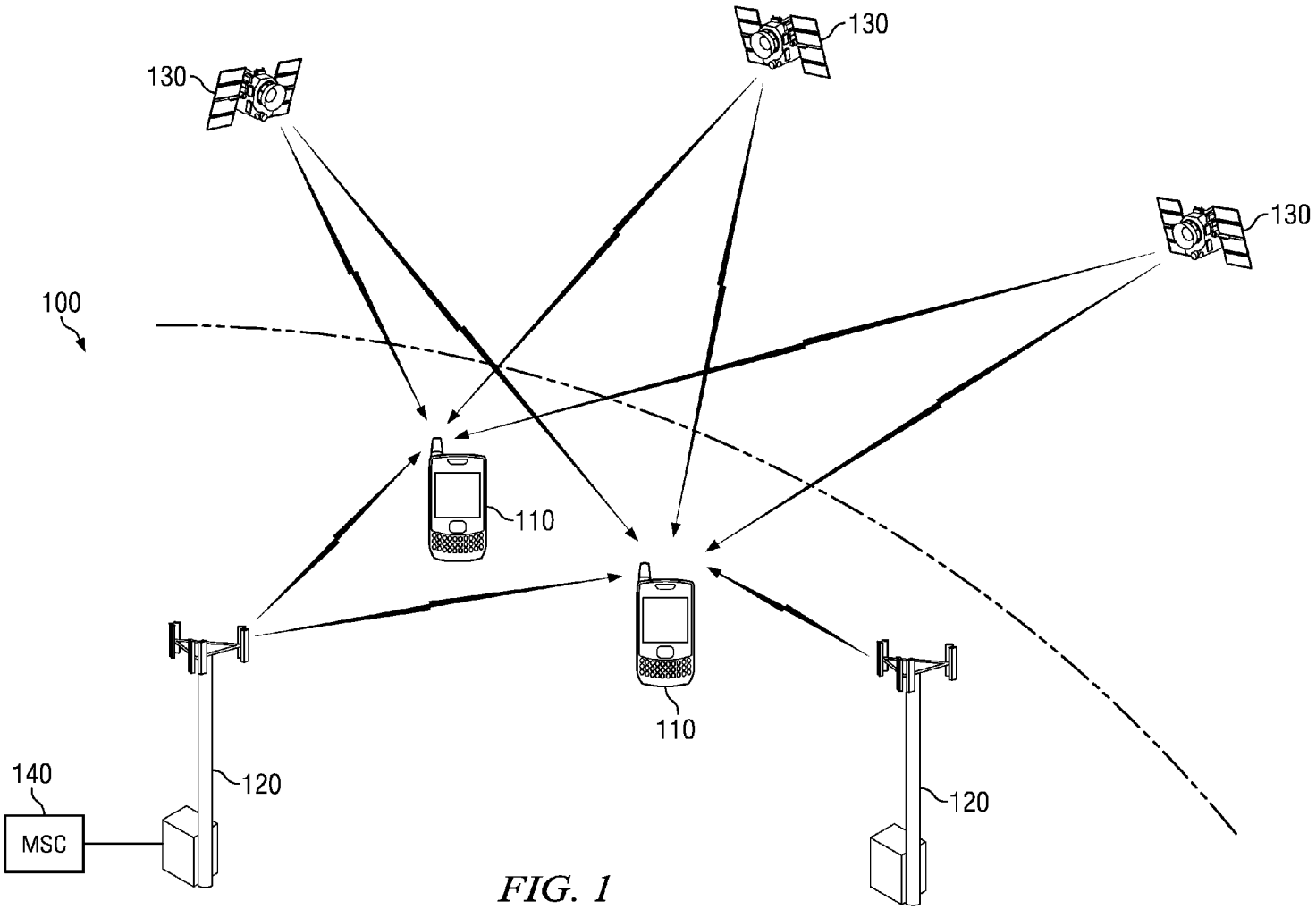
FIG. 1 illustrates a block diagram of an example wireless communication system, in accordance with certain embodiments of the present disclosure.

The wireless telecommunications industry is an industry that requires electronic devices—especially portable electronic devices, such as cellular phones—to have increased performance requirements and capabilities that may also require an increase in voltage regulator performance capabilities. FIG. 1 illustrates a block diagram of an example wireless communication system 100, in accordance with certain embodiments of the present disclosure. For simplicity, only two terminals 110 and two base stations 120 are shown in FIG. 1. A terminal 110 may also be referred to as a remote station, a mobile station, an access terminal, user equipment (UE), a wireless communication device, a cellular phone, or some other terminology.

A base station 120 may be a fixed station and may also be referred to as an access point, a Node B, or some other terminology. A mobile switching center (MSC) 140 may be coupled to the base stations 120 and may provide coordination and control for base stations 120.

A terminal 110 may or may not be capable of receiving signals from satellites 130. Satellites 130 may belong to a satellite positioning system such as the well-known Global Positioning System (GPS). Each GPS satellite may transmit a GPS signal encoded with information that allows GPS receivers on earth to measure the time of arrival of the GPS signal. Measurements for a sufficient number of GPS satellites may be used to accurately estimate a three-dimensional position of a GPS receiver. A terminal 110 may also be capable of receiving signals from other types of transmitting sources such as a Bluetooth transmitter, a Wireless Fidelity (Wi-Fi) transmitter, a wireless local area network (WLAN) transmitter, an IEEE 802.11 transmitter, and any other suitable transmitter.

In FIG. 1, each terminal 110 is shown as receiving signals from multiple transmitting sources simultaneously, where a transmitting source may be a base station 120 or a satellite 130. In certain embodiments, a terminal 110 may also be a transmitting source. In general, a terminal 110 may receive signals from zero, one, or multiple transmitting sources at any given moment.

System 100 may be a Code Division Multiple Access (CDMA) system, a Time Division Multiple Access (TDMA) system, or some other wireless communication system. A CDMA system may implement one or more CDMA standards such as IS-95, IS-2000 (also commonly known as "1x"), IS-856 (also commonly known as "1xEV-DO"), Wideband-CDMA (W-CDMA), and so on. A TDMA system may implement one or more TDMA standards such as Global System for Mobile Communications (GSM). The W-CDMA standard is defined by a consortium known as 3GPP, and the IS-2000 and IS-856 standards are defined by a consortium known as 3GPP2.

Figure 2:
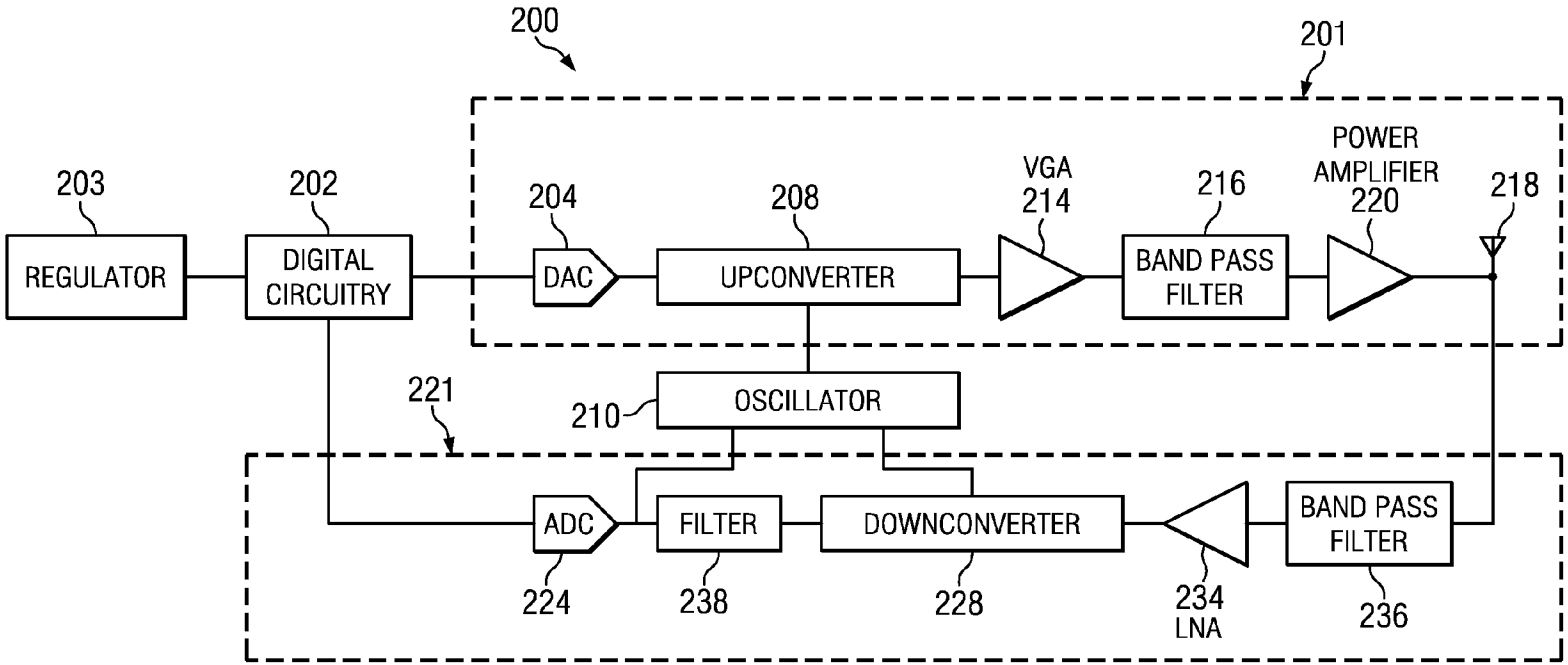
FIG. 2 illustrates an example block diagram of selected components of a transmitting and/or receiving element, in accordance with certain embodiments of the present disclosure.

FIG. 2 illustrates a block diagram of selected components of an example transmitting and/or receiving element 200

(e.g., a terminal 110, a base station 120, or a satellite 130), in accordance with certain embodiments of the present disclosure. Element 200 may include a transmit path 201 and/or a receive path 221. Depending on the functionality of element 200, element 200 may be considered a transmitter, a receiver, or a transceiver.

Transmitting source 200 may include one or more voltage regulators 203. Voltage regulator 203 may comprise any system, apparatus or device configured to regulate the voltage supplied to one or more of the various circuits and components included in transmitting source 200. In some instances, voltage regulators 203 may comprise a low dropout (LDO) linear regulator. In the present example, voltage regulator 203 is depicted as providing power to digital circuitry 202. However, it is understood that transmitting source 200 may include other regulators configured to provide power to other components of transmitting source 200.

Digital circuitry 202 may include any system, device, or apparatus configured to process digital signals and information received via receive path 221, and/or configured to process signals and information for transmission via transmit path 201. Such digital circuitry 202 may include one or more microprocessors, digital signal processors, and/or other suitable devices.

Transmit path 201 may include a digital-to-analog converter (DAC) 204. DAC 204 may be configured to receive a digital signal from digital circuitry 202 and convert such digital signal into an analog signal. Such analog signal may then be passed to one or more other components of transmit path 201, including upconverter 208.

Upconverter 208 may be configured to frequency upconvert an analog signal received from DAC 204 to a wireless communication signal at a radio frequency based on an oscillator signal provided by oscillator 210. Oscillator 210 may be any suitable device, system, or apparatus configured to produce an analog waveform of a particular frequency for modulation or upconversion of an analog signal to a wireless communication signal, or for demodulation or downconversion of a wireless communication signal to an analog signal. In some embodiments, oscillator 210 may be a digitally-controlled crystal oscillator.

Transmit path 201 may include a variable-gain amplifier (VGA) 214 to amplify an upconverted signal for transmission, and a bandpass filter 216 configured to receive an amplified signal VGA 214 and pass signal components in the band of interest and remove out-of-band noise and undesired signals. The bandpass filtered signal may be received by power amplifier 220 where it is amplified for transmission via antenna 218. Antenna 218 may receive the amplified and transmit such signal (e.g., to one or more of a terminal 110, a base station 120, and/or a satellite 130).

Receive path 221 may include a bandpass filter 236 configured to receive a wireless communication signal (e.g., from a terminal 110, a base station 120, and/or a satellite 130) via antenna 218. Bandpass filter 236 may pass signal components in the band of interest and remove out-of-band noise and undesired signals. In addition, receive path 221 may include a low-noise amplifiers (LNA) 224 to amplify a signal received from bandpass filter 236.

Receive path 221 may also include a downconverter 228. Downconverter 228 may be configured to frequency downconvert a wireless communication signal received via antenna 218 and amplified by LNA 234 by an oscillator signal provided by oscillator 210 (e.g., downconvert to a baseband signal).

Receive path 221 may further include a filter 238, which may be configured to filter a downconverted wireless communication signal in order to pass the signal components within a radio-frequency channel of interest and/or to remove noise and undesired signals that may be generated by the downconversion process. In addition, receive path 221 may include an analog-to-digital converter (ADC) 224 configured to receive an analog signal from filter 238 and convert such analog signal into a digital signal. Such digital signal may then be passed to digital circuitry 202 for processing.

As mentioned earlier, transmitting source 200 may comprise a wireless device powered by a battery. Some of the circuitry included in transmitting source 200 may require a higher voltage at higher temperatures and a lower voltage at lower temperatures for proper operation. Accordingly, regulator 203 may comprise a temperature dependent voltage regulator. A temperature dependent voltage regulator may be advantageous by providing higher voltage to the temperature dependent circuitry at higher temperatures and by providing lower voltage to the temperature dependent circuitry at lower temperatures.

A temperature dependent voltage regulator may reduce power consumption and increase battery life of a transmitting source 200 compared to a conventional voltage regulator. A conventional voltage regulator may be configured to constantly operate at a high voltage associated with the voltage requirements of the temperature dependent circuitry to meet worst case scenario design specifications. However, by constantly operating at the higher voltage level, even when the circuitry powered by the regulator may function properly at a lower voltage—due to the circuitry operating in a lower temperature environment—the circuitry may consume more power than necessary. Accordingly, a temperature dependent voltage regulator may ensure that the temperature dependent circuitry is powered at the proper voltage level at high temperatures. Additionally, the temperature dependent regulator may lower its output voltage at lower temperatures such that the temperature dependent regulator may provide the temperature dependent circuitry with adequate voltage but also may reduce power consumption.

Modifications, additions or omissions may be made to FIG. 2 without departing from the scope of the present disclosure. For example, transmitting source 200 is depicted as including only one regulator 203 coupled to and providing power to digital circuitry 202. However, regulator 203 may be coupled to other components of transmitting source 200 (e.g., components included in transmit path 201, oscillator 210, and components included in receive path 221, etc.). Additionally, transmitting source 200 may include a plurality of regulators 203 coupled to one or more of the components of transmitting source 200.

Further, regulator 203 has been described with respect to being used in a telecommunications device. However, the utilization of a temperature dependent regulator, such as regulator 203 should not be limited to such. A temperature dependent regulator may be used with respect to any suitable system, apparatus or device where varying the voltage output by temperature may prove to be useful.

Figure 3:
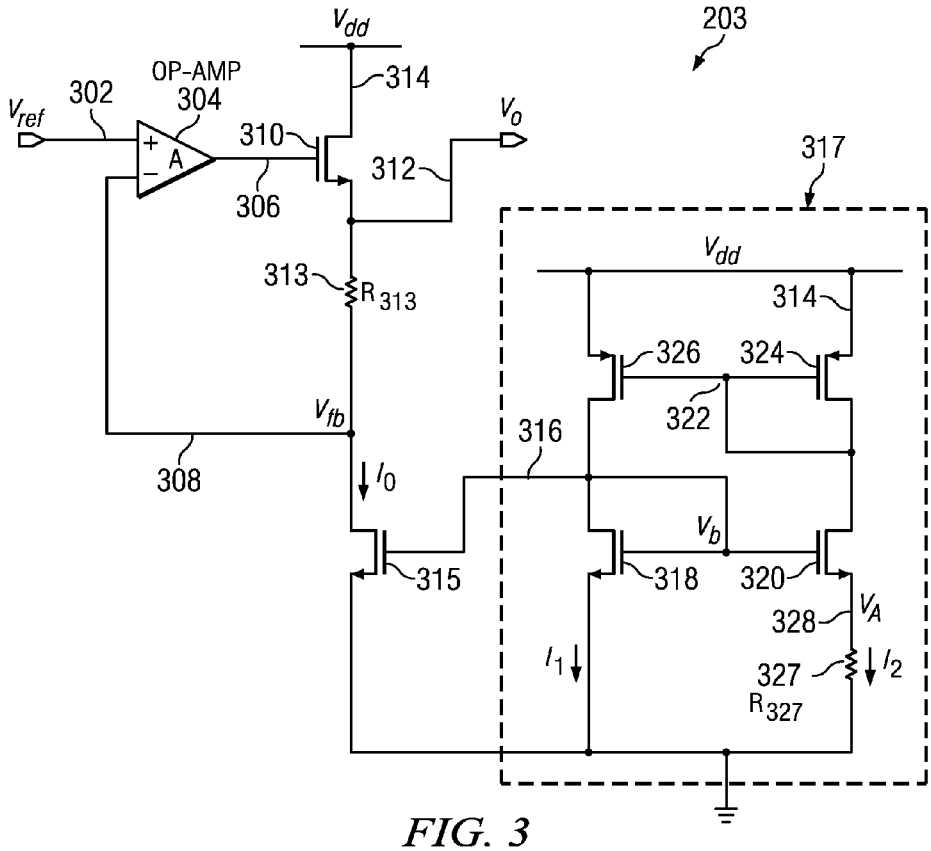
FIG. 3 illustrates an example schematic of a regulator configured to have a temperature dependent output voltage, in accordance with certain embodiments of the present disclosure.

FIG. 3 illustrates an example schematic of a temperature dependent voltage regulator 203. In the present example, regulator 203 may include a low drop-out (LDO) regulator. Regulator 203 may include a reference node 302 having a reference voltage ($V_{ref}$). $V_{ref}$ may control an output voltage ($V_o$) at an output node 312 of regulator 203. Output node 312 and output voltage $V_o$ may be configured to supply power to one or more load circuits. Due to the relationship between reference voltage $V_{ref}$ and output voltage $V_o$, reference voltage $V_{ref}$ may be selected to provide the appropriate output voltage $V_o$ to drive the one or more load circuits.

In the present example, regulator 203 may include an operational amplifier (op amp) 304 coupled, at its non-inverting terminal, to reference node 302 and configured to drive output voltage $V_o$ according to reference voltage $V_{ref}$. The non-inverting terminal of op amp 304 may be coupled to reference node 302 such that the voltage received at the non-inverting terminal of op amp 304 may be approximately equal to reference voltage $V_{ref}$. The inverting terminal of op amp 304 may be coupled to a resistor 313 having a resistance ($R_{313}$) and a regulating transistor 315 at a feedback node 308 having a feedback voltage $V_{fb}$. Due to the high impedance between the inverting and non-inverting terminals of op amp 304, the voltage at feedback node 308 ($V_{fb}$) may be approximately equal to the voltage at reference node 302 ($V_{ref}$).

The voltage at output node 312 ($V_o$) may be approximately equal to the amount of voltage drop across resistor 313 plus the voltage at feedback node 308 ($V_{fb}$). A regulating current $I_0$ may pass through resistor 313 from output node 312 to feedback node 308. The voltage drop across resistor 313 ($V_{R313}$) may be represented by Ohm's law and therefore may be represented by the following equation:

$$V_{R313} \approx I_0 R_{313}$$

Therefore, output voltage $V_o$ may be represented by the following equation:

$$V_o \approx V_{fb} + (I_0 R_{313})$$

As mentioned earlier, $V_{fb}$ may be approximately equal to $V_{ref}$ due to the characteristics of op amp 304. Thus, $V_o$ may be represented by the following equation:

$$V_o \approx V_{ref} + (I_0 R_{313})$$

Therefore, by approximately matching $V_{fb}$ to $V_{ref}$, op amp 304 may drive $V_o$ based at least in part on $V_{ref}$.

Additionally, the output of op amp 304 may be coupled to the gate of a pass transistor 310 at a gate node 306. Pass transistor 310 may comprise any suitable transistor driven by op amp 304 and configured to allow current to pass through it to supply regulating current $I_0$. In the example depicted in FIG. 3, pass transistor 310 may comprise an npn metal-oxide-semiconductor field-effect transistor (n-type MOSFET or NMOS). Pass transistor 310 may be configured such that current passing from its drain to its source may supply regulating current $I_0$. For example, the drain of pass transistor 310 may be coupled to a power supply node 314 having a supply voltage $V_{dd}$ and the source of pass transistor 310 may be coupled to output node 312. Supply node 314 may be configured to provide power to one or more components of regulator 203. The amount of current passing through pass transistor 310 may be related to the voltage at the gate of pass transistor 310. As noted above, op amp 304 may be configured to drive the voltage at the gate of pass transistor 310. Accordingly, op amp 304 may be configured to drive regulating current $I_0$, from which $V_o$ may depend.

Although the present example depicts pass transistor 310 as comprising an NMOS transistor configured with respect to op amp 304 and output node 312 in a particular manner, the present disclosure should not be limited to such. Any appropriate transistor and op amp configuration that may provide a current and generate an output voltage at an output node based on a reference voltage and current (e.g., regulating current $I_0$) may be used without departing from the scope of the present disclosure.

Returning back to FIG. 3, as mentioned above, the output voltage ($V_o$) of regulator 203 may be related to the amount of regulating current $I_0$ passing through resistor 313. Regulator 203 may be configured such that the amount of regulating current $I_0$ passing through resistor 313 is related to temperature. Therefore, regulator 203 may be configured to modify the output voltage $V_o$ based at least in part on temperature by modifying regulating current $I_0$ based at least in part on temperature.

Regulator 203 may be configured to adjust regulating current $I_0$ according to temperature by modifying the amount of regulating current $I_0$ with a proportional to absolute temperature (PTAT) circuit 317. In the present embodiment, using a regulating transistor 315, regulator 203 may be configured such that regulating current $I_0$ mirrors a temperature dependent current generated by PTAT circuit 317.

Regulating transistor 315 may comprise an NMOS transistor 315 configured such that regulating current $I_0$ passes through regulating transistor 315 to ground. Accordingly, the drain of regulating transistor 315 may be coupled to feedback node 308 and the source of regulating transistor 315 may be coupled to ground. Regulating transistor 315 may also be configured to control the amount of regulating current $I_0$, and therefore, control $V_o$. Although, op amp 304 and transistor 310 may also control the amount of regulating current $I_0$, by being coupled to feedback node 308 and ground, regulating transistor 315 may be configured to complete the circuit carrying $I_0$ and, therefore, also control the amount of regulating current $I_0$.

In the present embodiment, the gate of regulating transistor 315 may be coupled to the drain of an NMOS intermediate transistor 318, included in PTAT circuit 317, at a gate node 316. The gate of intermediate transistor 318 may also be coupled to gate node 316 such that the current passing through regulating transistor 315 ($I_0$) follows or "mirrors" the current passing through intermediate transistor 318 ($I_1$)—such that transistors 315 and 318 may be configured as a "current mirror." As described in further detail, transistor 318 of PTAT circuit may be configured such that current $I_1$ depends on temperature, accordingly, due to current $I_0$ "mirroring" current $I_1$, current $I_0$ may also be temperature dependent.

A "current mirror" may comprise any configuration wherein the current passing through one transistor is related to the current passing through another transistor. In a current mirror, the current passing through one transistor need not be equal to the current passing through the other transistor, but may be related to the current passing through the other transistor. The relationship between the current passing through the two transistors may be a function of the relationship between the channel width and length ratio of the two transistors. For example, in the present embodiment regulating transistor 315 may have a channel width and length ratio of $(W/L)_{315}$ and intermediate transistor 318 may have a channel width and length ratio of $(W/L)_{318}$. The relationship between regulating current $I_0$ (the current passing through regulating transistor 315) and intermediate current $I_1$ (the current passing through intermediate transistor 318) may be represented by the following equation:

$$I_0 \approx I_1 \frac{(W/L)_{315}}{(W/L)_{318}}$$

In the present example $(W/L)_{315}$ may be approximately equal to $(W/L)_{318}$ such that $I_0$ may be approximately equal to $I_1$.

The gate of NMOS adjustment transistor 320 may be coupled to the gates of transistors 318 and 315 at gate node 316 also, such that adjustment transistor 320 and 318 also comprise a current mirror (the current relationship between transistors 318 and 320 will be described in further detail). Therefore, adjustment transistor 320 may be configured to drive intermediate current $I_1$ which may in turn drive the current of $I_0$, which may in turn drive output voltage $V_o$.

Transistors 318 and 320 may be biased at the weak inversion or sub-threshold region such that $I_1$ and $I_2$ are temperature dependent. For example, in the present embodiment, $I_1$ may be represented by the following equation:

$$I_1 \approx I_{1,Q}\exp\left[\frac{(V_{gs}-V_{th})}{nV_T}\right]$$

$I_{1,Q}$ may represent the drain current of intermediate transistor 318 when $V_{gs}$ of intermediate transistor 318 is approximately equal to $V_{th}$ of intermediate transistor 318. $I_{1,Q}$ may be represented by the following equation:

$$I_{1,Q} \approx I_M(W/L)_{318}$$

$I_M$ may represent a drain current that is independent of the size of intermediate transistor 318. $V_{gs}$ of intermediate transistor 318 may represent the voltage difference between the gate of intermediate transistor 318 and the source of intermediate transistor 318. In the present example, the source of intermediate transistor 318 may be coupled to ground and the gate may be coupled to gate node 316 having a voltage $V_G$, such that $V_{gs}$ of intermediate transistor 318 may be approximately equal to $V_G$. $V_{th}$ of intermediate transistor 318 may represent the threshold voltage of intermediate transistor 318.

$V_T$ of intermediate transistor 318 may represent the thermal voltage of intermediate transistor 318 and n may represent a process dependent device parameter. $V_T$ and n may together represent a sub-threshold slope (S) of a MOSFET. In the present example, S may approximately be between 70 mV~90 mV at 300° Kelvin (K). The sub-threshold slope may be expressed by the following equation:

$$S \approx nVT.$$

$V_T$ of intermediate transistor 318 may approximately represent the thermal voltage of intermediate transistor 318 and may be expressed by the following equation:

$$V_T \approx \frac{kT}{q}$$

Therefore, the sub-threshold slope may be represented by the following equation:

$$S \approx nV_T \approx \frac{nkT}{q}$$

The Boltzman constant may be represented by k, electron charge may be represented by q and T may represent temperature. Therefore, $I_1$ may also be expressed by the following equation:

$$I_1 \approx I_M(W/L)_{318}\exp\left[\frac{q(V_G-V_{th})}{nkT}\right]$$

As mentioned above, adjustment transistor 320 may be biased in the weak inversion/sub-threshold region similar to intermediate transistor 318. Accordingly, the current passing through adjustment transistor 320 ($I_2$) may be represented by the following equation:

$$I_2 \approx I_{2,Q}\exp\left[\frac{(V_{gs}-V_{th})}{nV_T}\right]$$

As mentioned earlier, $V_{gs}$ of adjustment transistor 320 may represent the difference between the gate voltage ($V_g$) of adjustment transistor 320 and the source voltage ($V_s$) of adjustment transistor 320. The gate of adjustment transistor 320 may be coupled to gate node 316 having gate voltage $V_G$, such that the gate voltage ($V_g$) of adjustment transistor 320 is approximately equal to $V_G$.

The source of adjustment transistor 320 may also be coupled to a adjustment node 328 having an adjustment voltage ($V_A$), such that the source voltage ($V_s$) of adjustment transistor 320 is approximately equal to $V_A$. An adjustment resistor 327 having a resistance $R_{327}$, may also be coupled to adjustment node 328 and ground. Therefore, current passing through adjustment transistor 320 ($I_2$) may also pass through resistor 327 to ground. Accordingly, using Ohm's law, the voltage at adjustment node 328 ($V_A$) may be approximately equal to the voltage drop across resistor 327 ($V_{R327}$), as represented by the following equation:

$$V_A \approx V_{R327} \approx (I_2R_{327})$$

Therefore, $V_{gs}$ of adjustment transistor 320 may be represented by the following equation:

$$V_{gs} \approx V_G - V_A \approx V_G - (I_2R_{327})$$

Additionally, $I_{2,Q}$ may be represented by the following equation:

$$I_{2,Q} \approx I_M(W/L)_{320}$$

Similar to $V_T$ with respect to $I_1$, $V_T$ with respect to $I_2$ may also be represented by the following equation:

$$V_T \approx \frac{kT}{q}$$

Therefore, $I_2$ may be represented by the following equation:

$$I_2 \approx I_M(W/L)_{320}\exp\left[\frac{q(V_G-I_2R_{327}-V_{th})}{nkT}\right] \approx I_M(W/L)_{320}\frac{\exp\left[\frac{q(V_G-V_{th})}{nkT}\right]}{\exp\left[\frac{q(I_2R_{327})}{nkT}\right]}$$

From the above equations approximating $I_1$ and $I_2$, the relationship between $I_1$ and $I_2$ may be represented by the following equation:

$$\frac{I_1}{I_2} \approx \frac{(W/L)_{318}}{(W/L)_{320}}\exp\left[\frac{q(I_2R_{327})}{nkT}\right]$$

Additionally, in the present embodiment, the drain of intermediate transistor 318 may be coupled to the drain of a pnp MOSFET (PMOS) transistor 326. The source of transistor 326 may be coupled to supply node 314 having supply voltage $V_{dd}$, such that intermediate current $I_1$ may pass through transistor 326 before passing through intermediate transistor 318. Accordingly, transistor 326 may also influence intermediate current $I_1$. Similarly, the drain of adjustment transistor 320 may be coupled to the drain PMOS transistor 324. The source of transistor 324 may be coupled to supply node 314 having supply voltage $V_{dd}$, such that adjustment current $I_2$ may pass through transistor 324 before passing through adjustment transistor 320. Accordingly, transistor 324 may also influence adjustment current $I_2$.

Transistors 326 and 324 may be biased in the saturation region and may also comprise a current mirror. Therefore, the relationship between the current passing through transistor 326 ($I_1$) and the current passing through transistor 324 ($I_2$) may be related to the channel width to length ratio of transistors 326 and 324 and may be represented by the following equation:

$$\frac{I_1}{I_2} \approx \frac{(W/L)_{326}}{(W/L)_{324}}$$

In the present embodiment, $(W/L)_{326}$ may be approximately equal to $(W/L)_{324}$, therefore, $I_1$ may be approximately equal to $I_2$. With $I_1$ being approximately equal to $I_2$, the equation relating $I_1$ and $I_2$ with respect to transistors 318 and 320 may be represented by the following equation:

$$\frac{I_1}{I_2} \approx 1 \approx \frac{(W/L)_{318}}{(W/L)_{320}} \exp\left[\frac{q(I_2 R_{327})}{nkT}\right]$$

Therefore, by solving the above equation for $I_2$, $I_2$ may be represented by the following equation:

$$I_2 \approx \frac{nk}{qR_{327}} T \ln\left[\frac{(W/L)_{320}}{(W/L)_{318}}\right]$$

As already noted, in the present embodiment, $I_1$ may be approximately equal to $I_2$, and $I_0$ may be related to $I_1$ based on the width to length ratio of transistors 318 and 315. In the present embodiment, the width to length ratios of transistors 318 and 315 may be approximately equal to each other such that $I_0$ may be approximately equal to $I_1$, and therefore, $I_0$ may be approximately equal to $I_2$. Accordingly, in the present embodiment, $I_0$ may be represented by the following equation:

$$I_0 \approx I_2 \approx \frac{nk}{qR_{327}} T \ln\left[\frac{(W/L)_{320}}{(W/L)_{318}}\right]$$

Additionally, as noted earlier, output voltage $V_o$ may be a function of $I_0$, and therefore output voltage $V_o$ may be represented by the following equation:

$$V_o \approx V_{ref} + (I_0 R_{313}) \approx V_{ref} + \left(\frac{R_{313}}{R_{327}} \frac{nk}{q} T \ln\left[\frac{(W/L)_{320}}{(W/L)_{318}}\right]\right)$$

Therefore, output voltage $V_o$ of regulator 203 may be a function of temperature. From the above equation it can be seen that the amount of change in $V_o$ based on the change in temperature—a temperature coefficient ($T_c$) of output voltage $V_o$—may be a function of the ratio between $R_{313}$ and $R_{327}$ ($R_{313}/R_{327}$), and the ratio between $(W/L)_{320}$ and $(W/L)_{318}$ ($(W/L)_{320}/(W/L)_{318}$). The temperature coefficient ($T_c$) of output voltage $V_o$ may be expressed by the following equation:

$$T_c \approx \frac{\partial V_o}{\partial T} \approx \left(\frac{R_{313}}{R_{327}} \frac{nk}{q} \ln\left[\frac{(W/L)_{320}}{(W/L)_{318}}\right]\right)$$

Accordingly, $R_{313}$, $R_{327}$, and $(W/L)_{320}/(W/L)_{318}$ may be adjusted during design of regulator 203 to achieve a desired temperature coefficient of output voltage $V_o$.

Additionally, by combining the equation for the temperature coefficient $T_c$, with the equation for the output voltage $V_o$, the output voltage $V_o$ may be represented by the following equation:

$$V_o \approx V_{ref} + (I_0 R_{313}) \approx V_{ref} + \left(\frac{R_{313}}{R_{327}} \frac{nk}{q} T \ln\left[\frac{(W/L)_{320}}{(W/L)_{318}}\right]\right) \approx V_{ref} + TT_c$$

Therefore, by the ratio between $R_{313}$ and $R_{327}$, modifying the ratio between $(W/L)_{320}$ and $(W/L)_{318}$, or both, the amount of change in $V_o$ due to a change in temperature T may also be modified. Accordingly, regulator 203 may be designed to have the appropriate output voltage at the varying temperatures of regulator 203.

For example, regulator 203 may supply voltage to circuits that may require a voltage of approximately 1.5 volts at a higher temperature (e.g., approximately 363° K), approximately 1.4 volts at an ambient temperature (e.g., approximately 300° K) and approximately 1.3 volts at a lower temperature (e.g., approximately 233° K). Accordingly, the ratio between $R_{313}$ and $R_{327}$, the ratio between $(W/L)_{320}$ and $(W/L)_{318}$, or both, may be adjusted such that the output voltage $V_o$ approximates these levels at these temperatures.

For example, $V_{ref}$ may be approximately 1.1 volts, the sub-threshold slope (S) of transistors 318 and 320 may be approximately equal to seventy milli-volts (70 mV). Additionally, $R_{313}$ may be approximately equal to two hundred thirty kiloohms (230 kΩ) and $R_{327}$ may be approximately equal to one hundred kiloohms (100 kΩ). Also, $$\frac{(W/L)_{320}}{(W/L)_{318}}$$

may be approximately equal to eight (8). As noted earlier the sub-threshold slope may be expressed by the following equation:

$$S \approx \frac{nkT}{q}$$

Therefore, in the present example of a threshold slope of approximately 70 mv at 300° K, (nk/q), in the equation approximating output voltage $V_o$, nk/q may be determined with the following equation:

$$\frac{nk}{q} \approx \frac{S}{T} \approx \frac{70\text{ mV}}{300\text{ K}} \approx 0.23\text{ mV}/^\circ\text{ K}$$

Thus, in the present example, the temperature coefficient may be expressed by the following equation:

$$T_c \approx \left(\frac{R_{313}}{R_{327}}\frac{nk}{q}\ln\left[\frac{(W/L)_{320}}{(W/L)_{318}}\right]\right) \approx \left(\frac{230\text{ k}\Omega}{100\text{ k}\Omega}\right) * 0.23\text{ mV}/^\circ\text{ K} * \ln(8) \approx 1.1\text{ mV}/^\circ\text{ K}$$

Accordingly, the output voltage $V_o$ at an ambient temperature of 300° K may be represented by the following equation:

$$V_o \approx V_{ref} + TT_c \approx 1.1\text{V} + 300^\circ\text{ K} * 1.1\text{ mV}/^\circ\text{ K} \approx 1.4\text{V}$$

Using the same equation, the output voltage $V_o$ at a higher temperature of 363° K may be approximately equal to 1.5 V, and the output voltage $V_o$ at a lower temperature of 233° K may be approximately equal to 1.3 V. Therefore, in the present example, the present embodiment may be configured such that the output voltage is a function of temperature and may also be configured such that the output voltage approximately achieves a desired voltage level for a particular temperature. Accordingly, by varying the output voltage $V_o$ with the temperature, regulator 203 may consume less power and preserve more energy, thus adding benefits such as longer battery life in handheld devices.

Modifications, additions or omissions may be made to regulator 203 in FIG. 3 without departing from the scope of the present disclosure. For example, although a particular PTAT circuit has been described, any suitable PTAT circuit configured to alter the output voltage $V_o$ of regulator 203 may be used. Additionally, the components of regulator 203, such as the transistors, have been described with respect to specific types and sizes of transistors, but any suitable transistor that may be used to perform the described functions may also be used.

Figure 4:
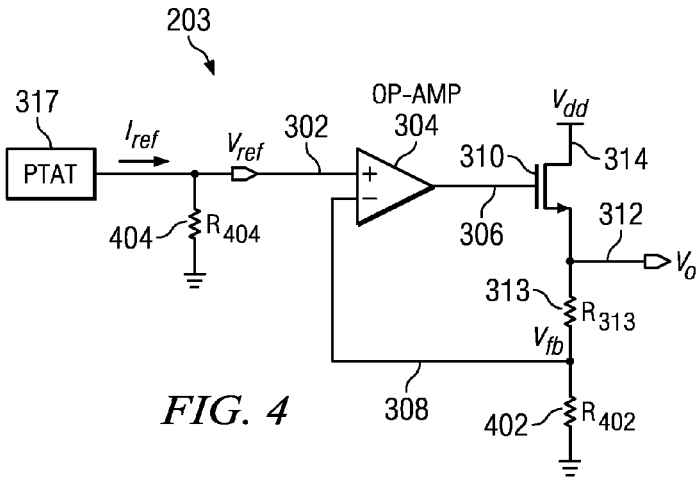
FIG. 4 illustrates another example schematic of a regulator configured to have a temperature dependent output voltage, in accordance with certain embodiments of the present disclosure.

FIG. 4 illustrates another example schematic of a regulator 203 configured to have a temperature dependent output voltage, in accordance with certain embodiments of the present disclosure. Regulator 203 may comprise a reference node 302 having a reference voltage $V_{ref}$, an op-amp 304, a pass transistor 310, an output node 312 having an output voltage $V_o$, a feedback node 308 and a resistor 313 coupled to output node 312 and feedback node 308, configured in a substantially similar manner as those described with respect to FIG. 3.

However, regulator 203 of FIG. 4 may also include a PTAT circuit 317 and a resistor 404 coupled to reference node 302, such that PTAT circuit 317 may modify $V_{ref}$ according to temperature. Accordingly, as explained above, due to $V_o$ being a function of $V_{ref}$, regulator 203 of FIG. 4 may modify $V_o$ based at least in part on temperature. Regulator 203 of FIG. 4 may also include a resistor 402 coupled to feedback node 308 and ground such that the current passing from output node 312 to ground through resistors 313 and 402 may not be a function of temperature. Therefore, regulator 203 of FIG. 4 may be configured to vary $V_o$ according to temperature by varying $V_{ref}$ according to temperature instead of varying $V_o$ according to temperature by varying the current passing through resistor 313 according to temperature as described with respect to FIG. 3.

In the present example, PTAT circuit 317 may be configured to output a temperature dependent reference current $I_{ref}$ such that $I_{ref}$ may pass through resistor 404, having a resistance $R_{404}$, to ground. Due to Ohm's law, reference voltage $V_{ref}$ may be a function of $I_{ref}$ and $R_{404}$. Therefore, due to the temperature dependency of $I_{ref}$, $V_{ref}$ may also be temperature dependent.

In the present embodiment, the temperature coefficient of the present embodiment may be a function of the resistive value of resistor 404 and the resistive values of one or more resistors included in PTAT circuit 317. Additionally, the temperature coefficient may be a function of channel width to length ratios of transistors included in PTAT circuit 317. Therefore, the appropriate temperature coefficient to achieve the desired voltage at various temperature levels may be achieved by configuring one or more of these components.

Modifications, additions or omissions may be made to FIG. 4 without departing from the scope of the present disclosure. For example, the configuration of PTAT circuit 317 with respect to reference node 302 may be any suitable configuration such that $V_{ref}$ is a function of the temperature dependent current $I_{ref}$, and as such, the disclosure should not be limited to the present configuration.

Figure 5:
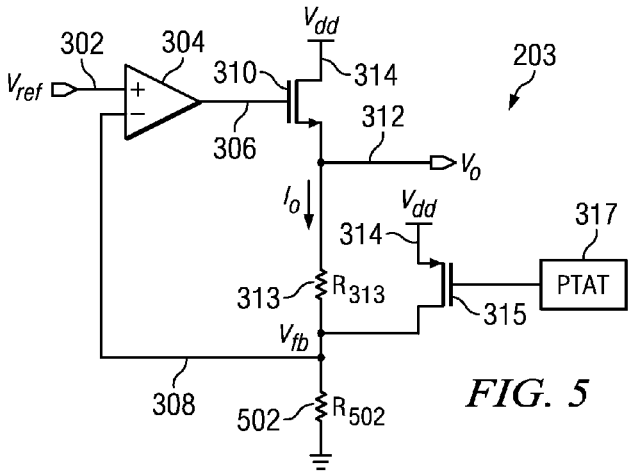
FIG. 5 illustrates a further example schematic of a regulator configured to have a temperature dependent output voltage, in accordance with certain embodiments of the present disclosure.

FIG. 5 illustrates a further example schematic of a regulator configured to have a temperature dependent output voltage, in accordance with certain embodiments of the present disclosure. Regulator 203 of FIG. 5 may comprise a reference node 302 having a reference voltage $V_{ref}$, an op-amp 304, a pass transistor 310, an output node 312 having an output voltage $V_o$, a feedback node 308 and a resistor 313 coupled to output node 312 and feedback node 308, configured in a substantially similar manner as those described with respect to FIG. 3. Additionally, similar to in FIG. 3, regulator 203 of FIG. 5 may include a transistor 315 coupled to a PTAT circuit 317 such that the current flowing through transistor 315 mirrors the temperature dependent current of PTAT circuit.

However, unlike in FIG. 3, transistor 315 may be coupled to supply node 314 and feedback node 308, such that current flows through transistor 315 from supply node 314 to feedback node 308. Further, transistor 315 may comprise a PMOS transistor instead of an NMOS transistor. Additionally, in the present embodiment, regulator 203 may include a resistor 502 having a resistance $R_{502}$ coupled to feedback node 308 and ground.

Further, unlike in FIG. 3, in the present configuration, the temperature coefficient may be negative such that $V_o$ decreases due to an increase in temperature and increases due to a decrease in temperature. As mentioned above with respect to FIG. 3, $V_o$ may be a function of the regulating current $I_0$ passing through resistor 313 and the voltage at feedback node 308 ($V_{fb}$). Additionally, due to the characteristics of op amp 304, $V_{fb}$ may be maintained at approximately the same voltage as $V_{ref}$—in some instances $V_{fb}$ may change while op amp 304 is responding to loads being applied or removed at output node 312, but typically $V_{fb}$ may be relatively constant. Therefore, due to Ohm's law the current passing through resistor 502 may also be relatively constant. In the current configuration, PTAT circuit 317 may be configured to increase its output current as the temperature increases, such that the current passing through transistor 315 may also increase. Based on Kirchhoff's current law with respect to feedback node 308, due to the current passing through resistor 502 remaining relatively steady, as the current passing through transistor 315 increases, the current passing through resistor 313 may decrease. Therefore, based on Ohm's law, the voltage across resistor 313 may decrease, which may cause $V_o$ to decrease. Accordingly, as the temperature increases, $V_o$ may decrease and vice versa.

In the present embodiment, the temperature coefficient of the present embodiment may be a function of the resistive values of resistor 313 and resistor 502 ($R_{313}$ and $R_{502}$). Additionally, the temperature coefficient may be a function of the resistive values of one or more resistors and channel width to length ratios of transistors included in PTAT circuit 317. Therefore, the appropriate temperature coefficient to achieve the desired voltage at various temperature levels may be achieved by configuring one or more of these components.

Modifications, additions or omissions may be made to FIG. 5 without departing from the scope of the present disclosure. For example, the configuration of PTAT circuit 317 with respect to output node 312 may be any suitable configuration such that $V_o$ decreases with an increase in temperature and increases as a function of temperature, and as such, the disclosure should not be limited to the present configuration.

Figure 6:
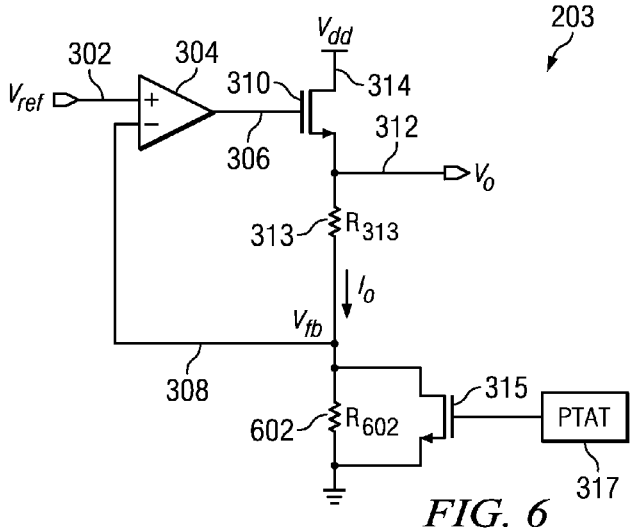
FIG. 6 illustrates an additional example schematic of a regulator configured to have a temperature dependent output voltage, in accordance with certain embodiments of the present disclosure.

FIG. 6 illustrates an additional example schematic of a regulator configured to have a temperature dependent output voltage, in accordance with certain embodiments of the present disclosure. Regulator 203 of FIG. 6 may comprise a reference node 302 having a reference voltage $V_{ref}$, an op-amp 304, a pass transistor 310, an output node 312 having an output voltage $V_o$, a feedback node 308 and a resistor 313 coupled to output node 312 and feedback node 308, configured in a substantially similar manner as those described with respect to FIG. 3. Additionally, similar to in FIG. 3, regulator 203 of FIG. 6 may include a transistor 315 coupled to a PTAT circuit 317 such that the current flowing through transistor 315 mirrors the temperature dependent current of PTAT circuit. Further, transistor 315 may be coupled to feedback node 308 and ground similarly to the configuration of FIG. 3.

However, unlike in FIG. 3, regulator 203 may also include a resistor 602 coupled to feedback node 308 and ground such that resistor 602 is electrically parallel to transistor 315. PTAT circuit 317 and transistor 315 may be similarly configured such that as the temperature increases, the current passing through transistor 315 increases. Additionally, due to Ohm's law and Kirchhoff s current law, as the current passing through transistor 315 increases, a regulating current $I_0$ passing through resistor 313 may increase, causing $V_o$ to increase. Therefore, regulator 203 of FIG. 6 may function similarly to regulator 203 of FIG. 3. However the temperature coefficient in FIG. 6 may also be a function of the resistance $R_{602}$ of resistor 602.

In addition to being a function of the resistive value of resistor 602 ($R_{602}$), the temperature coefficient of the present embodiment may be a function of the resistive values of resistor 313 and the resistive values of one or more resistors and channel width to length ratios of transistors included in PTAT circuit 317. Therefore, the appropriate temperature coefficient to achieve the desired voltage at various temperature levels may be achieved by configuring one or more of these components.

Modifications, additions or omissions may be made to FIG. 6 without departing from the scope of the present disclosure. For example, the configuration of PTAT circuit 317 with respect to output node 312 may be any suitable configuration such that $V_o$ is a function of the temperature dependent current $I_0$, and as such, the disclosure should not be limited to the present configuration.

Additionally, although specific configurations of varying the output voltage of a voltage regulator with a PTAT circuit have been disclosed with respect to FIGS. 3-6, the present disclosure should not be limited to such. Any suitable configuration where a PTAT circuit may modify voltages or currents as a function of temperature such that the output voltage of a voltage regulator is a function of temperature may be contemplated. Additionally, one or more of the disclosed configurations may be combined. For example, a voltage regulator may include a PTAT circuit configured to vary the reference voltage as a function of temperature and also a PTAT circuit configured to vary the regulating current as a function of temperature.

Figure 7:
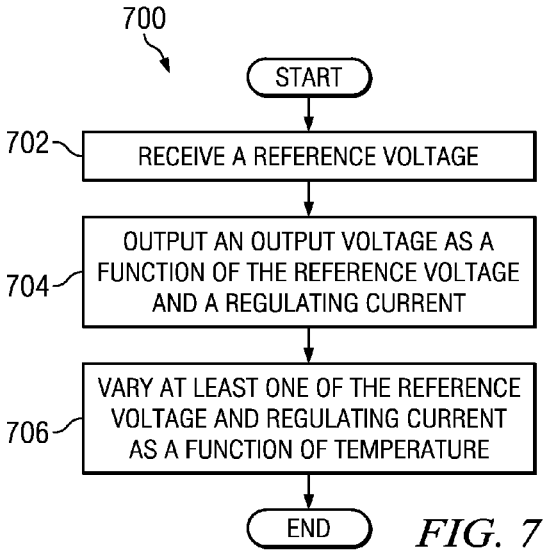
FIG. 7 illustrates an example method for regulating the output voltage of a voltage regulator based on temperature, in accordance with certain embodiments of the present disclosure.

FIG. 7 illustrates an example method 700 for regulating the output voltage of a voltage regulator based on temperature. Method 700 may begin at step 702 where a voltage regulator may receive a reference voltage at an input node (e.g., regulator 203 receiving reference voltage $V_{ref}$, at reference node 302).

At step 704 the voltage regulator may output an output voltage as a function of the reference voltage and a regulating current passing through a resistor coupled to the output node (e.g., output voltage $V_o$ of regulator 203 may be a function of $V_{ref}$ and $I_0$).

At step 706, a PTAT circuit coupled to the voltage regulator may vary at least one of the reference voltage and the regulating current partially based on the temperature. For example, a PTAT circuit may vary the reference voltage as a function of temperature similar to that described with respect to FIG. 4. In the same or another embodiment, a PTAT circuit may vary the regulating current as function of temperature similar to that described with respect to FIGS. 3, 5 and 6. Accordingly, due to the output voltage being a function of the regulating current and the reference voltage, and the regulating current and reference voltage being a function of the temperature, the PTAT circuit of the voltage regulator may adjust the output voltage based at least in part on temperature. Following step 706, method 700 may end. Modifications, additions or omissions may be made to method 700 without departing from the scope of the present disclosure. For example, the regulating current may be a function of an intermediate current which may be a function of the adjustment current, but this step has not been explicitly mentioned in method 700.

Although the present disclosure and its advantages have been described in detail, it should be understood that various changes, substitutions and alterations can be made herein without departing from the spirit and scope of the disclosure as defined by the following claims.

What is claimed is:

1. A voltage regulator comprising:

an amplifier comprising a first input node configured to receive a reference voltage, a second input node coupled to a feedback node, and an amplifier output;

an output transistor configured to be driven by the amplifier output;

an output node coupled to a first conducting terminal of the output transistor and configured to output an output voltage;

a feedback resistor coupled between the output node and the feedback node;

a regulating transistor coupled between the feedback node and ground, the regulating transistor configured in series with the feedback resistor such that a feedback current through the feedback resistor is approximately equal to a regulating current driven by the regulating transistor; and a proportional to absolute temperature (PTAT) circuit configured to drive the regulating transistor and to vary the regulating current and the output voltage as a function of temperature.

2. The regulator of claim 1, the PTAT circuit configured to drive the regulating transistor such that as temperature increases the regulating current increases and as temperature decreases the regulating current decreases.

3. The regulator of claim 1, the PTAT circuit including a current mirror comprising a first transistor and a second transistor, the PTAT circuit configured to vary the regulating current as a function of a first channel width to length ratio of the first transistor and a second channel width to length ratio of the second transistor.

4. A wireless communication element, comprising:

a receive path configured to receive a first wireless communication signal and convert the first wireless communication signal into a first digital signal;

a transmit path configured to convert a second digital signal into a second wireless communication signal and transmit the second wireless communication signal; and a voltage regulator comprising:

an amplifier comprising a first input node configured to receive a reference voltage, a second input node coupled to a feedback node, and an amplifier output;

an output transistor configured to be driven by the amplifier output;

an output node coupled to a first conducting terminal of the output transistor and configured to output an output voltage;

a feedback resistor coupled between the output node and the feedback node;

a regulating transistor coupled between the feedback node and ground, the regulating transistor configured in series with the feedback resistor such that a feedback current through the feedback resistor is approximately equal to a regulating current driven by the regulating transistor; and a proportional to absolute temperature (PTAT) circuit configured to vary the regulating current and the output voltage as a function of temperature.

5. The communication element of claim 4, the PTAT circuit configured to drive the regulating transistor such that as temperature increases the regulating current increases and as temperature decreases the regulating current decreases.

6. The communication element of claim 4, the PTAT circuit including a current mirror comprising a first transistor and a second transistor, the PTAT circuit configured to vary the regulating current as a function of a first channel width to length ratio of the first transistor and a second channel width to length ratio of the second transistor.

7. A method comprising:

receiving, by a voltage regulator, a reference voltage at a first amplifier input node;

receiving a feedback signal at a second amplifier input node coupled to a feedback node;

driving an output transistor coupled to an amplifier output;

outputting, by the voltage regulator, an output voltage at an output node coupled to a first conducting terminal of the output transistor;

providing the feedback signal to the second amplifier input node through a feedback resistor coupled between the output node and the feedback node;

providing a regulating current at the feedback node with a regulating transistor coupled in series with the feedback resistor such that a feedback current through the feedback resistor is approximately equal to the regulating current through the regulating transistor;

driving the regulating transistor with a proportional to absolute temperature (PTAT) circuit;

varying, by the PTAT circuit driving the regulating transistor, the regulating current and the output voltage as a function of temperature.

8. The method of claim 7, further comprising increasing the regulating current as temperature increases and decreasing the regulating current as temperature decreases.

9. The method of claim 7, further comprising varying the regulating current as a function of a first channel width to length ratio of a first transistor of the PTAT circuit and a second channel width to length ratio of a second transistor of the PTAT circuit.

* * * * *